US008728703B2

(12) United States Patent
Yamashita et al.

(10) Patent No.: US 8,728,703 B2
(45) Date of Patent: May 20, 2014

(54) ELECTROPHOTOGRAPHIC TONER, METHOD FOR PRODUCING TONER, DEVELOPER AND IMAGE FORMING APPARATUS CONTAINING TONER

(75) Inventors: Hiroshi Yamashita, Shizuoka (JP); Satoyuki Sekiguchi, Shizuoka (JP); Daisuke Asahina, Shizuoka (JP); Tsuyoshi Sugimoto, Shizuoka (JP); Masaki Watanabe, Shizuoka (JP); Rintaro Takahashi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/540,063

(22) Filed: Jul. 2, 2012

(65) Prior Publication Data

US 2013/0011778 A1 Jan. 10, 2013

(30) Foreign Application Priority Data

Jul. 6, 2011 (JP) ..... 2011-149645

(51) Int. Cl.
*G03G 9/087* (2006.01)

(52) U.S. Cl.
USPC ..... 430/137.17; 430/137.14; 430/137.15

(58) Field of Classification Search
USPC ..... 430/137.17, 137.14, 137.15
See application file for complete search history.

(56) References Cited

U.S. PATENT DOCUMENTS

| | | | | |
|---|---|---|---|---|
| 5,780,195 | A * | 7/1998 | Nava | 430/109.2 |
| 6,861,191 | B2 * | 3/2005 | Mochizuki et al. | 430/109.2 |
| 2010/0316944 | A1 | 12/2010 | Nakajima et al. | |
| 2011/0033794 | A1 | 2/2011 | Watanabe et al. | |
| 2011/0076610 | A1 | 3/2011 | Ogawa et al. | |
| 2011/0076612 | A1 | 3/2011 | Awamura et al. | |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2011-13570 | 1/2011 |

OTHER PUBLICATIONS

Abstract of JP 62008166, Jan. 16, 1987.*
Abstract of JP 2000162822, Jun. 16, 2000.*

* cited by examiner

*Primary Examiner* — Hoa V Le
(74) *Attorney, Agent, or Firm* — Oblon, Spivak, McClelland, Maier & Neustadt, L.L.P.

(57) ABSTRACT

An electrophotographic toner obtained from a dispersion or emulsion liquid of an oil phase containing a toner material in an aqueous medium, the toner including: a binder resin, wherein the toner material includes: (A) an epoxy resin prepolymer; (B) an adduct of a dihydric phenol with a polyalkylene oxide; (C) a phenolic compound, or an alcohol compound, or both thereof; and (D) a carboxylic acid compound, and wherein the binder resin includes a resin obtained by allowing the (A), the (B), the (C) and the (D) to react with each other.

1 Claim, 1 Drawing Sheet

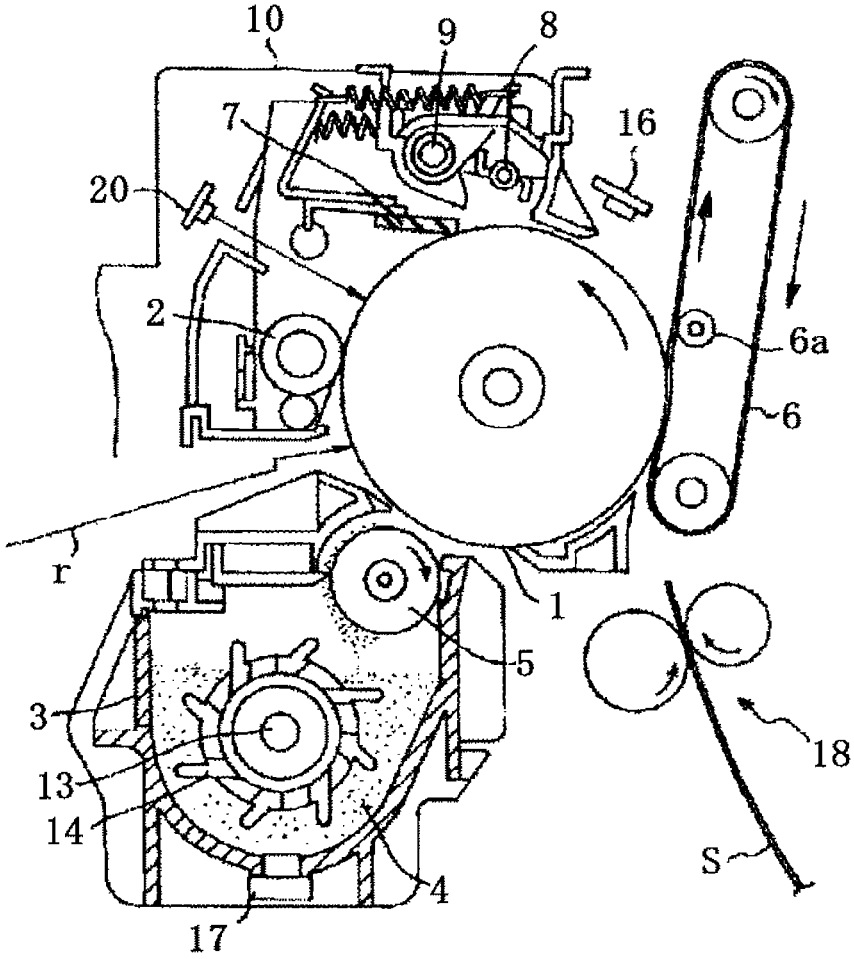
10
9
8
7
16
20
2
6a
6
r
1
5
3
13
14
4
17
18
S

ELECTROPHOTOGRAPHIC TONER, METHOD FOR PRODUCING TONER, DEVELOPER AND IMAGE FORMING APPARATUS CONTAINING TONER

BACKGROUND OF THE INVENTION

1. Field of the Invention

The present invention relates to an electrophotographic toner and a method for producing a toner, and to a developer and an image forming apparatus that contain the toner.

2. Description of the Related Art

In recent years, demand has arisen on the market for toners having various advantageous properties such as small particle diameters for forming high-quality output images and improved low-temperature fixing property for energy saving.

Toners obtained by the conventional kneading-pulverizing method are not easily made to have a small particle diameter. In addition, their shape is amorphous and their particle size distribution is broad. Furthermore, these toners have various problems such as requiring a large amount of energy for being fixed.

In particular, a toner produced by the kneading-pulverizing method causes a problem related to fixing. Specifically, cracks occur at the interfaces of releasing agent (wax) during pulverization, resulting in that the wax exists on the surface of the toner particle in a large amount.

As a result, although the releasing effects can be obtained, toner adhesion to a carrier, a photoconductor and a blade is likely to occur. The properties of such toners are not satisfactory in total.

In order to overcome the above-described problems the kneading-pulverizing method has, there is proposed a method for producing a toner by the polymerization method.

According to the polymerization method, toners are made easily to have a small particle diameter. Their particle size distribution is sharper than that of the toners obtained by the pulverizing method. Furthermore, the wax can be embedded in the toner particles.

As a toner production method based on the polymerization method, Japanese Patent Application Laid-Open (JP-A) No. 11-133665 discloses a method for producing a toner having a practical sphericity of 0.90 to 1.00. In this method, the toner is produced from an elongation reaction product of a urethane-modified polyester serving as a toner binder, for the purpose of improving the toner in flowability, low-temperature fixing property and hot offset resistance.

Besides, for example, JP-A Nos. 2002-287400 and 2002-351143 disclose a method for producing a toner excellent in all of heat resistance storage stability, low-temperature fixing property and hot offset resistance. The toner produced with this method has a small particle diameter to be excellent in flowability as powder and transferability.

The toner production methods disclosed in JP-A Nos. 11-133665, 2002-287400 and 2002-351143 each include a step of allowing a polyester resin, and if necessary, an isocyanate group-containing polyester prepolymer to undergo polymerization addition reaction with an amine in the reaction system containing an organic solvent and an aqueous medium to increase the molecular weight.

However, the toner obtained by the above-described method is increased in hot offset resistance but degraded in low-temperature fixing property and in glossiness after fixing. This is because toner particles are produced in the aqueous medium and thus materials with high polarity such as a pigment cannot be retained in the toner particle and the materials with high polarity tend to locate on the surface of the toner particle. Therefore, the above-described method is still not satisfactory.

When an isocyanate group-containing polyester prepolymer is used, a large number of nitrogen atoms are located on the surfaces of the toner particles and produced polymers have positive polarity. Thus, use of the isocyanate group-containing polyester prepolymer is not suitable for the electrophotographic toner of negative polarity.

In addition, there has been disclosed a method for producing a toner binder including an aging step for producing a toner binder having a stable molecular weight distribution and achieving a favorable balance between low-temperature fixing property and hot offset resistance (see, for example, Japanese Patent (JP-B) No. 2579150 and JP-A No. 2001-158819).

The production methods of the toner binder disclosed in JP-B No. 2579150 and JP-A No. 2001-158819 are easily applicable to condensation polymerization reaction which is performed at a high temperature. But, they are not applicable to the above-described reaction system, which contains an organic solvent and an aqueous medium, without conducting studies on suitable conditions. Thus, it is difficult to obtain a toner that contains wax embedded in the toner particles and that has a sharp particle size distribution.

SUMMARY OF THE INVENTION

The present invention aims to solve the above existing problems and achieve the following objects. Specifically, an object of the present invention is to provide a toner exhibiting stable low-temperature fixing property and hot offset resistance and having satisfactory charge stability even when it is negatively charged containing the toner; a developer; and an image forming apparatus containing the toner.

Means for solving the above problems are as follows.

<1>An electrophotographic toner obtained from a dispersion or emulsion liquid of an oil phase containing a toner material in an aqueous medium, the toner including:

a binder resin, wherein the toner material contains: (A) an epoxy resin prepolymer; (B) an adduct of a dihydric phenol with a polyalkylene oxide; (C) a phenolic compound, or an alcohol compound, or both thereof, and (D) a carboxylic acid compound, and wherein the binder resin includes a resin obtained by allowing the (A), the (B), the (C) and the (D) to react with each other.

<2>An electrophotographic toner obtained from a dispersion or emulsion liquid of an oil phase containing a toner material in an aqueous medium, the toner including:

a binder resin, wherein the toner material contains: (A) an epoxy resin prepolymer; and (E) a polyester resin containing a hydroxyl group or a carboxyl group and a backbone unit of an adduct of a dihydric phenol with a polyalkylene oxide, and wherein the binder resin includes a resin obtained by allowing the (A) and the (E) to react with each other.

<3> A method for producing an electrophotographic toner, including:

emulsifying or dispersing, in an aqueous medium, an oil phase containing a toner material, where the toner material contains:

(A) an epoxy resin prepolymer;

(B) an adduct of a dihydric phenol with a polyalkylene oxide;

(C) a phenolic compound, or an alcohol compound, or both thereof, and (D) a carboxylic acid compound; and allowing the (A), the (B), the (C), and the (D) to react with each other during, or after, or during and after the emulsification or dispersion to obtain a resin, wherein the electrophotographic toner is obtained from a dispersion or emulsion liquid of the oil phase in the aqueous medium, wherein the toner contains a binder resin, and wherein the binder resin contains the resin obtained by allowing the (A), the (B), the (C) and the (D) to react with each other.

<4> A method for producing an electrophotographic toner, including:

emulsifying or dispersing, in an aqueous medium, an oil phase containing a toner material, where the toner material contains:

(A) an epoxy resin prepolymer; and (E) a polyester resin containing a hydroxyl group or a carboxyl group and a backbone unit of an adduct of a dihydric phenol with a polyalkylene oxide; and allowing the (A) and the (E) to react with each other during, or after, or during and after the emulsification or dispersion to obtain a resin, wherein the electrophotographic toner is obtained from a dispersion or emulsion liquid of the oil phase containing in the aqueous medium, wherein the toner contains a binder resin, and wherein the binder resin includes the resin obtained by allowing the (A) and the (E) to react with each other.

<5> A developer including:

the toner of <1> or <2>; and a carrier.

<6> An image forming apparatus including:

a developing unit containing the toner of <1> or <2>.

As can be understood from the following detail and specific explanation, the present invention can provide a toner exhibiting stable low-temperature fixing property and hot offset resistance and having satisfactory charge stability even when it is negatively charged; a developer containing the toner; and an image forming apparatus that contain the toner.

BRIEF DESCRIPTION OF THE DRAWINGS

FIG. 1 is a schematic view of the configuration of an electrophotographic image forming apparatus employing an electrophotographic process in accordance with one example of the image forming method of the present invention.

DETAILED DESCRIPTION OF THE INVENTION

The electrophotographic toner of the present invention will be described in detail.

The toner of the present invention is an electrophotographic toner obtained from a dispersion or emulsion liquid of an oil phase containing a toner material in an aqueous medium, the toner including a binder resin, wherein the toner material includes: (A) an epoxy resin prepolymer; (B) an adduct of a dihydric phenol with a polyalkylene oxide; (C) a phenolic compound and/or an alcohol compound; and (D) a carboxylic acid compound, or including: (A) an epoxy resin prepolymer; and (E) a polyester resin containing a hydroxyl group or a carboxyl group and a backbone unit of an adduct of a dihydric phenol with a polyalkylene oxide, and wherein the binder resin includes a resin obtained by allowing the (A), the (B), the (C) and the (D), or the (A) and the (E) to react with each other.

The glycol site of the (A) epoxy resin prepolymer generates an ether bond. Binder resins containing a glycol site and/or an ether bond have high polarity and the main chain part thereof is highly flexible. Thus, such binder resins tend to be present at the surface of the oil droplets in an aqueous medium. This prevents surface exposure of the toner material such as a colorant and a releasing agent in oil droplets. In addition, toners containing such binder resin have high adhesiveness to a recording medium such as paper and have improved hot offset resistance, allowing the extension of a fixing temperature range.

Preferably, the binder resin has an epoxy value of 20,000 or more and substantially does not have an epoxy group. Binder resins that do not have an epoxy group have excellent stability during production.

In order to prepare a binder resin that does not have an epoxy group, the epoxy group at the terminus is allowed to react with monohydric phenol or excessive amounts of dihydric phenols.

The binder resin is preferably synthesized using at least two bisphenol A epoxy resin prepolymers that have different number average molecular weights from each other. Use of bisphenol A epoxy resin prepolymers that have different number average molecular weights from each other allows us to obtain a binder resin with an appropriate molecular weight distribution, making it possible to obtain clear color images.

In this case, it is preferable that the number average molecular weight of the low molecular component of the prepolymer is 360 to 2,000, and the number average molecular weight of the high molecular component of the prepolymer is 3,000 to 10,000. The molecular weight distribution can be expressed as a ratio, Mv/Mn, of a number average molecular weight, Mn, and a volume average molecular weight, Mv. In the case of a color toner which has glossiness, Mv/Mn is preferably 3 to 8 and can be controlled by, for example, the ratio of the low molecular weight component and high molecular weight component of the epoxy resin prepolymer that are used for synthesis, and other known methods in the art.

The weight average molecular weight of the binder resin is preferably 2,000 to 30,000, more preferably 3,000 to 20,000.

The glass transition temperature of the binder resin is preferably 40° C. to 80° C., more preferably 50° C. to 70° C. When the glass transition temperature is lower than 40° C., the following phenomena tends to occur. Specifically, heat resistance storage stability of the toner is degraded, easily generating aggregates in a toner bottle or developing device. When developed images are transferred, the aggregates are not transferred, causing white voids in the portion of the image corresponding to the aggregates. Whereas when glass transition temperature is greater than 80° C., the following problems tend to occur. Specifically, the formed toner has inadequate low-temperature fixing property and also it is difficult to obtain images with satisfactory glossiness.

Also, the binder resin contains a polyalkylene glycol moiety in the main chain, enabling the formation of images with high glossiness.

The toner material includes, as a binder resin material, (A) an epoxy resin prepolymer, (B) an adduct of a dihydric phenol with a polyalkylene oxide, (C) a phenolic compound and/or an alcohol compound and (D) a carboxylic acid compound; or (A) an epoxy resin prepolymer and (E) a polyester resin having a hydroxyl group or a carboxyl group and a backbone unit of an adduct of a dihydric phenol with a polyalkylene oxide. The toner material may further contain appropriately selected other substances such as a colorant and a releasing agent.

Examples of the (A) epoxy resin prepolymer include those prepared through a condensation reaction between bisphenols (e.g., bisphenol A and bisphenol F) and epichlorohydrin. The amount of the (A) epoxy resin prepolymer to be added is preferably 25% by weight to 70% by weight.

The (B) adduct of a dihydric phenol with a polyalkylene oxide include, for example, those mentioned below.

Examples thereof include reaction products of polyalkylene glycols (e.g., polyethylene glycol, polypropylene glycol, polybutylene glycol and mixtures thereof) and bisphenols (e.g., bisphenol A, and bisphenol F). The obtained adducts may further be reacted with epichlorohydrin or β-methyl epichlorohydrin and the resulting glycidylated compounds may be used.

Particularly, diglycidyl ether of adducts of bisphenol A with an alkylene oxide, represented by the following General Formula (1), is preferable.

General Formula (1)

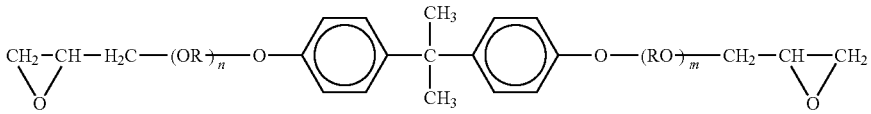

R represents any one of

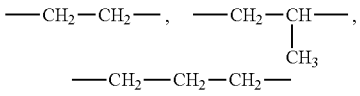

n and m each represent 1 or more and n+m=2 to 8

When n+m in the General Formula (I) exceeds 8, the glossiness is too high or storage stability is degraded in some cases. The amount of the (B) adduct of a dihydric phenol with a polyalkylene oxide to be added is preferably 10% by weight to 40% by weight.

The (C) phenolic compound and/or alcohol compound can be monohydric or higher phenolic compound and/or alcohol compound.

Examples of a monohydric alcohol component include components that are derived from benzyl alcohol, 4-t-butylbenzyl alcohol, dodecanol, or one-end capped polyethyleneglycol.

Examples of a monohydric phenol compound include phenol, cresol, isopropylphenol, amylphenol, nonylphenol, dodecylphenol, xylenol and p-cumylphenol.

Examples of a dihydric alcohol include alkylene glycols (e.g., ethylene glycol, 1,2-propylene glycol, 1,3-propylene glycol, 1,4-butanediol, neopentyl glycol, 1,4-butenediol, 1,5-pentanediol, 1,6-hexanediol), alkylene ether glycols (e.g., diethylene glycol, triethylene glycol, dipropylene glycol, polyethylene glycol, polypropylene glycol, polytetramethylene glycol), and alicyclic diols (e.g., 1,4-cyclohexanedimethanol and hydrogenated bisphenol A).

Examples of a dihydric phenolic compound include bisphenols (e.g. bisphenol A, bisphenol F, and bisphenol S).

Examples of a polyhydric alcohol include sorbitol, 1,2,3,6-hexanetetrol, 1,4-sorbitan, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxymethylbenzene.

The phenolic compound may be a polyester resin synthesized through a reaction of at least dihydric phenol with a polyalkylene glycol or a glycidyl ether thereof. These can be used alone or in combination.

This allows even a high molecular weight polyester resin to be included in the toner particles, reducing the phenomena of offset fixing at a high temperature. Thus, toners with a wide range of fixing temperature can be provided. In addition, such toner is superior in negative chargeability to the toner in which a high molecular weight polyester resin having an urea bond or a urethane bond is included in the toner particles.

Examples of those obtained through reaction of a dihydric phenol with a polyalkylene glycol or a glycidyl ether thereof include adducts of bisphenols such as bisphenol A, bisphenol F, and bisphenol S with polyethylene glycols, polypropylene glycols, polybutylene glycols. Among these, adducts of bisphenol A with 2 mol to 8 mol of a polyethylene glycol or a polypropylene glycol are preferable.

The (D) carboxylic acid compound can be a carboxylic acid compound having one or more carboxyl groups. Examples of a monocarboxylic acid component include components derived from benzoic acid, 4-t-butylbenzoic acid, or p-hydroxybenzoic acid. Examples of a dicarboxylic acid include aliphatic dicarboxylic acids and the derivatives thereof (e.g. maleic acid, fumaric acid, succinic acid, adipic acid, sebacic acid, malonic acid, azelaic acid, mesaconic acid, citraconic acid, glutaconic acid, octylsuccinic acid, decylsuccinic acid, decylsuccinic acid, dodecylsuccinic acid, tetradecylsuccinic acid, hexadecylsuccinic acid, octadecylsuccinic acid, isooctadecylsuccinic acid, hexenylsuccinic acid, octenylsuccinic acid, decenylsuccinic acid, dodecenylsuccinic acid, tetrapropenylsuccinic acid, tetradecenylsuccinic acid, hexadecenylsuccinic acid, isooctadecenylsuccinic acid, octadecenylsuccinic acid, and nonenylsuccinic acid); alicyclic dicarboxylic acids (e.g. cyclohexanedicarboxylic acid, and methylmedic acid); aromatic dicarboxylic acids (e.g. phthalic acid, isophthalic acid, terephthalic acid, toluenedicarboxylic acid, and naphthalenedicarboxylic acid); and anhydrides and lower alkyl (e.g. methyl and butyl) esters of the dicarboxylic acids. In particular, terephthalic acid and isophthalic acid are useful. Terephthalic acid has an effect on the increase of Tg and isophthalic acid has an effect on the enhancement of reactivity.

Examples of a polycarboxylic acid include trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid and 1,2,7,8-octanetetracarboxylic acid, and their acid anhydrides.

These can be used alone or in combination.

The monomer having a large number of functional groups, such as the above mentioned polyhydric alcohol and polycarboxylic acid provide an effect to increase Tg of the binder resin. In addition, the monomer having a large number of functional groups provides the binder resin with cohesiveness and provides an effect to improve offset resistance. Thus, the amount of the monomer having a large number of functional groups to be introduced in the binder resin is preferably 20% by mole or less so as to match the fixing temperature and copying speed of the copier.

Also, in the present invention, the monocarboxylic acid component and the monohydric alcohol component can be used. Since these compounds remarkably inhibit a reaction, it is desirable for the binder resin to contain these compounds in an amount of 10% by mole depending on the targeting degree of polymerization.

The (E) polyester resin containing a hydroxyl group or a carboxyl group and a backbone unit of an adduct of a dihydric phenol with a polyalkylene oxide.

As the binder resin of the present invention, other than the resin which is prepared by allowing the (A) epoxy resin prepolymer, the (B) adduct of a dihydric phenol with a polyalkylene oxide, the (C) phenolic compound and/or the alcohol compound, and the (D) carboxylic acid compound, or by allowing the (A) epoxy resin prepolymer and the (E) polyester resin having a hydroxyl group or a carboxyl group and a backbone unit of an adduct of a dihydric phenol with a polyalkylene oxide to react with each other, a masterbatch or fine resin particles, and other resins can be used in combination, within a range that does not adversely affect the object of the present invention, in order to control chargeability. The amount of other resins is preferably 60% by weight or less.

Specific examples of the other resins include those listed below.

As a binder resin having an ester bond, a polyester that does not contain a bond unit other than the ester bond, so-called unmodified polyesters can be used.

When negative chargeability is not provided, for example, such unmodified polyester, a binder resin precursor having the ester bond, a modified polyester containing an ester bond and a bond unit other than the ester bond, a resin precursor capable of generating the modified polyester, and a crystalline polyester can be used in combination to serve as a binder resin (toner binder) component.

For example, unmodified polyester (ii) and modified polyester (i) [e.g., urea-modified polyester] may be used as toner binder components.

When using (i) and (ii) in combination, the low-temperature fixing property is improved and, if used in a full-color image forming apparatus, the glossiness is also improved. Thus, using (i) and (ii) in combination is preferred as compared with using (i) alone. Also, (i) and (ii) are preferably compatible with each other at least partially, from the viewpoints of improvements in low-temperature fixing property and hot offset resistance. Therefore, the polyester component of (i) is preferably similar to that of (ii).

(Modified Polyester (i))

The modified polyester (i) in the present invention contains, in the molecular structure thereof, at least an ester bond and other bond units than the ester bond. Such modified polyester can be produced from a resin precursor capable of producing the modified polyester. For example, the modified polyester can be produced through reaction between a polyester containing a functional group reactive with an active hydrogen group and a compound containing the active hydrogen group.

Examples of the polyester containing a functional group reactive with an active hydrogen group include polyester prepolymers containing, for example, an isocyanate group or an epoxy group. Such polyester containing a functional group reactive with an active hydrogen group can be easily synthesized through reaction of a polyester (base reactant) and a conventionally known isocyanating agent (isocyanate group-containing compound) or epoxidizing agent (epoxy group-containing compound). For example, incorporation, into a binder resin, of a modified polyester produced through elongation reaction between an isocyanate group-containing polyester (polyester prepolymer) and an active hydrogen group-containing compound (e.g., an amine) can enlarge the difference between the minimum fixing temperature and hot offset-occurring temperature, and also improve the release range.

Examples of the isocyanating agent include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic-aliphatic diisocyanate (e.g., $\alpha,\alpha,\alpha',\alpha'$-tetramethylxylylene diisocyanate); isocyanurates; products obtained by blocking the above polyisocyanates with phenol derivatives, oxime or caprolactam; and mixtures thereof.

The epoxidizing agent is typified by, for example, epichlorohydrin.

As one example, next will be described a case where a modified polyester (i.e., modified polyester containing an ester bond and a urea bond) is synthesized through reaction between an active hydrogen group-containing compound (e.g., an amine) and an isocyanate group-containing polyester serving as a polyester having a functional group reactive with the active hydrogen group.

When the above-mentioned polyester having an isocyanate group is prepared, the ratio of the isocyanating agent to the polyester resin (base reactant) is generally 5/1 to 1/1, preferably 4/1 to 1.2/1, still more preferably 2.5/1 to 1.5/1, in terms of the equivalent ratio [NCO]/[OH] of the isocyanate group [NCO] to the hydroxyl group [OH] of the polyester resin (base reactant). When the ratio [NCO]/[OH] exceeds 5, the formed toner is degraded in low-temperature fixing property. When the [NCO] is less than 1, the urea content of the modified polyester is lowered, and the formed toner is degraded in hot offset resistance.

The amount of the isocyanating agent contained in the modified polyester is generally 0.5% by mass to 40% by mass, preferably 1% by mass to 30% by mass, still more preferably 2% by mass to 20% by mass. When the amount thereof is less than 0.5% by mass, the formed toner is degraded in hot offset resistance, and also is difficult to have both desired heat resistance storage stability and desired low-temperature fixing property. Whereas when the amount thereof exceeds 40% by mass, the formed toner is degraded in low-temperature fixing property.

The number of isocyanate groups contained per molecule of the modified polyester is generally 1 or more, preferably 1.5 to 3 on average, more preferably 1.8 to 2.5 on average. When the number thereof is less than 1 per molecule, the modified polyester (urea-modified polyester) obtained through elongation reaction is decreased in molecular weight, and thus, the formed toner is degraded in hot offset resistance.

When an amine is used as the active hydrogen group-containing compound, the amine includes, for example, a diamine compound, a trivalent or higher polyamine compound, an amino alcohol compound, an amino mercaptan compound, an amino acid compound, and compounds obtained by blocking the amino groups of these compounds.

Examples of the diamine compound include: aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diaminecyclohexane and isophoronediamine); and aliphatic diamines (e.g., ethylenediamine, tetramethylenediamine and hexamethylenediamine).

Examples of the trivalent or higher polyamine compound include diethylenetriamine and triethylenetetramine.

Examples of the amino alcohol compound include ethanolamine and hydroxyethylaniline.

Examples of the amino mercaptan compound include aminoethyl mercaptan and aminopropyl mercaptan.

Examples of the amino acid compound include aminopropionic acid and aminocaproic acid.

Examples of the compounds obtained by blocking the amino groups of these compounds include oxazoline compounds and ketimine compounds derived from the above amines and ketones (e.g., acetone, methy ethyl ketone and methyl isobutyl ketone).

Among these amines, preferred are the diamines, and mixtures each composed of any of the diamines and a small amount of any of the polyamines. The amine may be used also as a crosslinking agent or an elongating agent.

If necessary, an elongation terminator may be used so as to adjust the molecular weight of the modified polyester (urea-modified polyester). Examples of the elongation terminator include monoamines (e.g., diethylamine, dibutylamine, butylamine and laurylamine) and compounds obtained by blocking the monoamines (ketimine compounds).

As for the ratio of the amine, the equivalence ratio [NCO]/[NHx] of the isocyanate group [NCO] in the modified polyester to the amino group [NHx] in the amine is generally 1/2 to 2/1, preferably 1.5/1 to 1/1.5, more preferably 1.2/1 to 1/1.2. When the equivalence ratio [NCO]/[NHx] is greater than 2 or less than ½, the molecular weight of the urea-modified polyester obtained after elongation reaction is low, and thus there is a decrease in hot offset resistance.

In the present invention, the modified polyester (urea-modified polyester) may contain a urethane bond as well as a urea bond. The molar ratio of the amount of the urea bond to the amount of the urethane bond is generally 100/0 to 10/90, preferably 80/20 to 20/80, more preferably 60/40 to 30/70. When the molar ratio of the urea bond is less than 10%, there is a decrease in hot offset resistance.

The modified polyester (urea-modified polyester) obtained through elongation reaction between the isocyanate group-containing polyester and the amine is produced by a one-shot method or a prepolymer method. The weight average molecular weight of the urea-modified polyester is generally 10,000 or greater, preferably 20,000 to 10,000,000, more preferably 30,000 to 1,000,000. When it is less than 10,000, there is a decrease in hot offset resistance. The number average molecular weight of the urea-modified polyester is not particularly limited when the unmodified polyester is used; it may be such a number average molecular weight as helps obtain the above-mentioned weight average molecular weight. When the urea-modified polyester is solely used, its number average molecular weight is generally 20,000 or less, preferably 1,000 to 10,000, more preferably 2,000 to 8,000. When it is greater than 20,000, there is a decrease in low-temperature fixing property and, if the urea-modified polyester is used in a full-color image forming apparatus, there is a decrease in glossiness.

Note that the modified polyester (i) corresponds to the above-mentioned modified polyester (urea-modified polyester).

As mentioned above, the unmodified polyester (ii) in the present invention does not contain bond units other than an ester bond. The peak molecular weight of the unmodified polyester (ii) is generally 1,000 to 30,000, preferably 1,500 to 10,000, more preferably 2,000 to 8,000. When the peak molecular weight thereof is lower than 1,000, the heat resistance storage stability is degraded. Whereas when the peak molecular weight thereof is higher than 10,000, the low-temperature fixing property is degraded. The weight average molecular weight of the unmodified polyester (ii) is preferably 2,000 to 90,000 and the glass transition temperature (Tg) thereof is preferably 40° C. to 80° C.

The hydroxyl value of the unmodified polyester (ii) is preferably 5 mgKOH/g or more, more preferably 10 mgKOH/g to 120 mgKOH/g, still more preferably 20 mgKOH/g to 80 mgKOH/g. When the hydroxyl value thereof is lower than 5 mgKOH/g, it may be difficult to attain both desired heat resistance storage stability and desired low-temperature fixing property.

The acid value of unmodified polyester (ii) is generally 1 mgKOH/g to 30 mgKOH/g, preferably 5 mgKOH/g to 20 mgKOH/g. When the unmodified polyester has an acid value, the formed toner tends to be negatively charged.

When the acid value and the hydroxyl value exceed the above ranges, the formed toner is adversely affected by environmental factors under high-temperature, high-humidity or low-temperature, low-humidity environment, easily causing image failures. In the present invention, the acid value is measured using the method in accordance with JIS K0070-1992.

Specifically, first, 0.5 g of a sample (the amount of components thereof soluble in ethyl acetate is 0.3 g) is added into 120 mL of toluene and dissolved therein by stirring at 23° C. for approximately 10 hours.

Then 30 mL of ethanol is added to prepare a sample solution.

In the case where the sample is not dissolved, solvents such as dioxane and tetrahydrofuran are used.

Subsequently, the acid value is measured at 23° C. using the automatic potentiometric titrator DL-53 TITRATOR (manufactured by Mettler-Toledo International Inc.) and the electrode DG113-SC (manufactured by Mettler-Toledo International Inc.). The analysis software LABX LIGHT Version 1.00.000 is used for analysis.

A mixed solvent of 120 mL of toluene and 30 mL of ethanol is used for correction of the instrument.

The conditions for the measurement are the same as in the case of hydroxyl value.

The measurement for the acid value can be performed as described above; specifically, it is calculated as follows. Titration is carried out using a prescribed 0.1N potassium hydroxide/alcohol solution, and the acid value is calculated from the volume used for the titration using the following equation:

Acid value [mgKOH/g]=volume used for the titration [ml]×$N$×56.1 [mg/ml]/weight of sample [g], where $N$ is a factor of 0.1$N$ potassium hydroxide/alcohol solution.

In the present invention, the glass transition temperature of the unmodified polyester (ii) is preferably 40° C. to 70° C.

When it is lower than 40° C., the heat resistance storage stability of the formed toner may be degraded. Whereas when it is higher than 70° C., the low-temperature fixing property may be degraded.

The glass transition temperature may be measured in the present invention using Rigaku THRMOFLEX TG8110 (product of Rigaku Denki Co., Ltd.) and 10TG-DSC system TAS-100 (product of Rigaku Denki Co., Ltd.).

Specifically, a sample (about 10 mg) is placed in an aluminum container, which is placed on a holder unit. The holder unit is then set in an electric oven.

Then, the sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min for DSC analysis.

Using the analysis system of TAS-100 system, the glass transition temperature is calculated from the tangent point between the base line and the tangential line of the endothermic curve near the glass transition temperature.

When the toner contains a crystalline polyester (iii) together with the modified polyester (i), an ester group-containing wax mixture (various monoester waxes) used as the releasing agent of the present invention are finely dispersed in the toner particles, preventing contamination of the wax against a carrier and a charging member. Furthermore, it has been found that controlling the melt viscosity at 120° C. of the monoester group-containing wax contributes greatly to fine dispersion of the wax in the toner particles.

The mechanism by which the crystalline polyester improves fine dispersion of the monoester wax (monoester group containing wax) is not clear, but the following mechanism is presumed.

Specifically, the crystalline polyester and the monoester group containing wax are dispersed in a crystalline state without being dissolved in the amorphous resin in the base particles. The crystalline polyester has affinity to and thus easily accessible to the monoester group containing wax to promote their mutual dispersiblities, whereby the wax can finely be dispersed in the base particles.

In particular, when alkyl monoester compounds contain components having different total carbon atoms, one of the components has high affinity to the crystalline polyester (the one component may be a component having more carbon atoms) while another or other components have high affinity to the amorphous polyester component (the another or other components may be a component(s) having less carbon atoms). By virtue of these effects suitably combined together, the releasing agent (a plurality of monoester waxes) is satisfactorily dispersed in the binder resin (toner binder).

The crystalline polyester is originally used for improving fixability. However, in the present invention, the crystalline polyester is contained in the toner material together with a monoester group-containing wax mixture ("wax" for short) each having a melt viscosity at 120° C. of 1.0 mPa·sec to 20 mPa·sec. Use of the crystalline polyester allows the wax to be finely dispersed in the base particles, resulting in that the amount of the wax exposed on the surfaces of the base particles is reduced; i.e., the wax is not localized in the surfaces thereof, which maintains the total amount of the wax contained in the base particles. As a result, while releaseability during fixing is being maintained unchanged (without being degraded), contamination against the carrier and charging member due to the wax present in the surfaces of the toner particles containing the base particles is suppressed to obtain good results.

Regarding the dispersion particle diameter of the crystalline polyester in the base particles, preferably, the ratio of major axis diameter to minor axis diameter is 3 or more, and the major axis diameter is 0.2 μm to 3.0 μm. When the above ratio is less than 3 and the particle diameter is less than 0.2 μm, it is difficult for the crystalline polyester to show its crystallinity and thus it is difficult to obtain low-temperature fixability in the present invention. When the diameter of the crystal is too large; i.e., more than 3.0 μm, the toner particles are greatly deformed and then easily pulverized in the machine. In addition, the crystalline polyester having such crystal diameter is easily exposed to the surface of the toner particle. In an extreme case, the crystalline polyester independently exists outside the toner, finally contaminating parts of the machine. That is, adjusting the major axis diameter in the dispersion particle diameter to fall within a range of 0.2 μm to 3.0 μm ensures that the monoester waxes are finely dispersed in the base particles and prevents the wax from localized in the surfaces of the base particles.

The crystalline polyester preferably has an endothermic peak temperature of 50° C. to 150° C. as measured through differential scanning calorimetry (DSC).

When the endothermic peak temperature is lower than 50° C., the formed toner particles aggregate during storage at high temperatures to be degraded in heat resistance storage stability, resulting in that the toner particles easily cause blocking at temperatures of a developing device. Whereas when the endothermic peak temperature is higher than 150° C., the minimum fixing temperature of the formed toner becomes high not to obtain low-temperature fixing property.

When the crystalline polyester is used for the toner material, it is preferable that a crystalline polyester dispersion liquid is prepared in advance, and then this dispersion liquid is allowed to be included in the oil phase containing the toner material (toner material liquid).

The above crystalline polyester dispersion liquid refers to a liquid in which the crystalline polyester is finely dispersed preferably in the same solvent as the organic solvent used for the toner production. The crystalline polyester is used for the toner production with it being dispersed in the organic solvent. This allows the crystalline polyester to be present in oil droplets with the crystalline polyester finely dispersed therein when the oil phase containing the toner material is emulsified in an aqueous medium (aqueous phase). Therefore, the crystalline polyester can move to the oil-water interface in the droplets and base particles capable of exhibiting the effects of the toner of the present invention.

For example, the crystalline polyester is dissolved in an organic solvent by heating, recrystallized and precipitated by cooling. The particle diameter of the precipitates is larger than desired value in many cases and the precipitates are preferably subjected to further dispersion and pulverization. It is important that the matter or crystalline polyester having properties requiring such precipitation and dispersion is present (arranged) on the toner surface in the form of crystals of needle shapes because the presence (arrangement) thereof on the toner surface ensures low-temperature fixing property, durability, and cleanability.

Preferably, the crystalline polyester is uniformly dispersed in the toner particles. By uniformly dispersing the crystalline polyester, which has a function of aiding fixing and a property of rapidly melting, in the toner particles containing the base particles (toner), the crystalline polyester is rapidly diffused in the toner particles during heating, exhibiting good releaseability.

The cross-sectional surface of the toner particles can be observed and evaluated under a transmission electron microscope (TEM) as follows.

Specifically, the produced toner particles are subjected to vapor staining using a commercially available 5% by mass aqueous solution of ruthenium tetroxide. The thus-stained toner particles are embedded in an epoxy resin, and then cut with a diamond knife using a microtome (Ultracut-E) to prepare a section. The thickness of the section is adjusted to be about 100 nm based on the interference color of the epoxy resin. The prepared section is placed on a copper grid mesh where it is further subjected to vapor staining using a commercially available 5% by mass aqueous solution of ruthenium tetroxide. The obtained section is observed under a transmission electron microscope (product of JEOL Ltd., JEM-2100F) and images of the cross-sectional surfaces of the toner particles in the section are recorded. The cross-sectional surfaces of 20 toner particles are observed for the toner surface formed of the fine resin particles and the crystalline polyester (profile of the cross-sectional surface of the toner particle), to thereby evaluate how the fine resin particles and the crystalline polyester exist.

The toner particles themselves are stained before preparation of the section as described above and thus, the material for staining penetrates the surfaces of the toner particles. The coated film formed of the fine resin particles present in the uppermost surface of the toner particles to be photographed can be observed based on clearer difference in contrast. For example, when the coated film formed of the fine resin particles is different from organic components inside the coated film, the coated film can be discriminated from the resin inside the toner particles.

Furthermore, the section is further stained as described above and thus, the crystalline polyester can be observed with clear contrast. The crystalline polyester is stained more weakly than are other organic components inside the toner particles. This is likely because the degree of penetration of a material for staining into the crystalline polyester is lower than that in the case of other organic components inside the toner particles due to, for example, the difference in density therebetween. Depending on the degree of staining, the amount of ruthenium atoms is different. Strongly stained regions contain a large amount of ruthenium atoms, and do not transmit electron beams to be black in an observed image. While weakly stained regions contain a small amount of ruthenium atoms, and easily transmit electron beams to be white on an observed image.

The crystalline polyester is used as a crystalline polyester dispersion liquid (organic solvent dispersion liquid) containing a binder resin in an amount of 5 parts by mass to 25 parts by mass per 100 parts by mass of the dispersion liquid. The crystalline polyester preferably has an average particle diameter (dispersion diameter) of 200 nm to 3,000 nm.

When the dispersion diameter of the crystalline polyester is less than 200 nm, the crystalline polyester aggregates inside the base particles (approximately "toner"), resulting in that charge-imparting effect cannot sufficiently be obtained in some cases. Whereas when the dispersion diameter of the crystalline polyester is more than 3,000 nm, surface properties of the formed toner particles are degraded to contaminate the carrier, resulting in that sufficient chargeability cannot be maintained for a long period of time and also environmental stability may be degraded.

The organic solvent dispersion liquid of the crystalline polyester preferably contains the crystalline polyester in an amount of 5 parts by mass and polyester bond-containing binder resins other than the crystalline polyester in an amount of 5 parts by mass to 25 parts by mass, per 100 parts by mass of the dispersion liquid. More preferably, it contains the crystalline polyester in an amount of 5 parts by mass and the binder resins in an amount of 15 parts by mass. When the amount of the binder resin is less than 5 parts by mass, the dispersion diameter of the crystalline polyester does not become small in some cases. Whereas when the amount of the binder resin is more than 25 parts by mass, the organic solvent dispersion liquid of the crystalline polyester involves aggregation of the crystalline polyester when added to the solution or dispersion liquid of the toner material, resulting in that the low-temperature fixing effect cannot sufficiently be obtained in some cases.

Different from the crystalline polyester dispersoids of the present invention, in the case where the crystalline polyester is heated in an organic solvent and then cooled; the resultant solution is emulsified in an aqueous surfactant solution to obtain fine dispersoids; and the dispersoids are directly dried for use in toner production, there may be the following problems.

(1) Since the crystalline polyester is dissolved in an organic solvent and emulsified, the particles are spherical and do not maintain a crystalline state.

(2) Even if the crystalline polyester is precipitated upon cooling, coarse precipitates are emulsified not to obtain fine particles.

(3) The dispersoids are dried in the presence of a large amount of the surfactant (in an amount corresponding to 1/5 (20% by mass) with respect to the crystalline polyester) whereby fine particles aggregate and also are coated with the surfactant. The obtained particles are directly used in toner production and thus, are poor in dispersibility in the toner. In addition, the crystalline polyester cannot exhibit its effects even when melted during fixing.

The amount of the crystalline polyester is preferably 1 part by mass to 30 parts by mass per 100 parts by mass of the base particles (approximately "toner"). When the amount thereof is less than 1 part by mass, low-temperature fixing effect cannot sufficiently be obtained in some cases. Whereas when the amount thereof is higher than 30 parts by mass, the amount of the crystalline polyester present in the uppermost surface of the toner particle is too large and the crystalline polyester contaminates a photoconductor or other members, potentially decreasing image quality, flowability of the developer and image density. Also, surface properties of the formed toner particles are degraded to contaminate the carrier, resulting in that sufficient chargeability cannot be maintained for a long period of time and also environmental stability may be degraded.

As described above, the base particles forming the toner of the present invention may contain a crystalline polyester [hereinafter, referred to as a crystalline polyester (iii)].

The crystalline polyester (iii) is produced between an alcohol component and an acid component and is a polyester having at least a melting point.

Suitable crystalline polyester include crystalline polyesters synthesized using, as the alcohol component, a C2-C12 saturated aliphatic diol compound, especially, 1,4-butanediol, 1,6-hexanediol, 1,8-octanediol, 1,10-decanediol, 1,12-dodecanediol or a derivative thereof and, as the acid component, a C2-C12 dicarboxylic acid having a double bond (C=C bond), a C2-C12 saturated dicarboxylic acid, especially, fumaric acid, 1,4-butanedioic acid, 1,6-hexanedioic acid, 1,8-octanedioic acid, 1,10-decanedioic acid, 1,12-dodecanedioic acid or a derivative thereof.

In particular, from the viewpoint of making smaller the difference between the endothermic peak temperature and the endothermic shoulder temperature, the crystalline polyester preferably consists of one alcohol component which is 1,4-butanediol, 1,6-hexanediol, 1,8-octanediol, 1,10-decanediol or 1,12-dodecanediol and one dicarboxylic acid component which is fumaric acid, 1,4-butanedioic acid, 1,6-hexanedioic acid, 1,8-octanedioic acid, 1,10-decanedioic acid or 1,12-dodecanedioic acid.

Examples of the method for controlling the crystallinity and softening point of the crystalline polyester (iii) include a method in which the molecule of non-linear polyesters is appropriately designed. The non-linear polyester can be synthesized through condensation polymerization between the alcohol component additionally containing a tri or higher polyhydric alcohol (e.g., glycerin) and the acid component additionally containing a tri or higher polycarboxylic acid (e.g., trimellitic anhydride).

The molecular structure of the crystalline polyester (iii) can be confirmed through, for example, solid NMR.

As a result of the extensive studies conducted in view that, as described above, a crystalline polyester having a sharp molecular weight distribution and a low molecular weight is excellent in low-temperature fixing property, the molecular weight of the crystalline polyester is preferably adjusted as follows. Specifically, in a molecular weight distribution diagram obtained through GPC of the soluble matter of a sample in o-dichlorobenzene where the horizontal axis indicates log (M) and the vertical axis indicates % by mass, preferably, the peak is in the range of 3.5 to 4.0 and the half width of the peak is 1.5 or less. In addition, the weight average molecular weight (Mw) is 1,000 to 6,500, the number average molecular weight (Mn) is 500 to 2,000, and the Mw/Mn is 2 to 5.

The acid value of the crystalline polyester (iii) is preferably 8 mgKOH/g to 45 mgKOH/g. This is because, in order to attain intended low-temperature fixing property in terms of compatibility between paper and resin, the acid value thereof is preferably 8 mgKOH/g or higher, more preferably 20 mgKOH/g or higher, and also, in order to improve hot offset resistance, the acid value thereof is preferably 45 mgKOH/g or lower.

Also, the hydroxyl value of the crystalline polyester is preferably 0 mgKOH/g to 50 mgKOH/g, more preferably 5 mgKOH/g to 50 mgKOH/g, in order to attain desired low-temperature fixing property and excellent chargeability.

In the toner of the present invention, the binder resin (toner binder) may be, for example, a binder resin containing the modified polyester (i) and the unmodified polyester (ii), a binder resin containing the unmodified polyester (ii) and the crystalline polyester or a binder resin containing the modified polyester (1), the unmodified polyester (ii) and the crystalline polyester For example, when (i), (ii) and (iii) are used in combination, the ratio by mass [(i)/(ii)+(iii)] in the toner is generally 5/95 to 25/75, preferably 10/90 to 25/75, more preferably 12/88 to 25/75, particularly preferably 12/88 to 22/78, in order to allow the toner to exhibit low-temperature fixing property. Also, the ratio by mass [(ii)/(iii)] is 99/1 to 50/50, preferably 95/5 to 60/40, more preferably 90/10 to 65/35. When the ratio by mass between (i), (ii) and (iii) deviates from the above ranges, there is a decrease in hot offset resistance and there is a disadvantage in achieving both desired heat resistance storage stability and desired low-temperature fixing property.

By virtue of the presence of the urea-modified polyester as the unmodified polyester, the toner of the present invention containing the base particles tends to be superior in heat-resistant storageability to known polyester toners even if the glass transition temperature is low.

The temperature (TG') at which the storage elastic modulus of the toner binder is 10,000 dyne/cm$^2$, at a measurement frequency of 20 Hz, is generally 100° C. or higher, preferably 110° C. to 200° C. When this temperature is lower than 100° C., there is a decrease in hot offset resistance.

The temperature (Tη) at which the viscosity of the toner binder is 1,000 P, at a measurement frequency of 20 Hz, is generally 180° C. or lower, preferably 90° C. to 160° C. When this temperature is higher than 180° C., there is a decrease in low-temperature fixing property. Accordingly, it is desirable in terms of a balance between low-temperature fixing property and hot offset resistance that TG' be higher than Tη. In other words, the difference (TG'−Tη) between TG' and Tη is preferably 0° C. or greater, more preferably 10° C. or greater, particularly preferably 20° C. or greater.

The upper limit of the difference between TG' and Tη is not particularly limited. Also, in terms of a balance between heat resistance storage stability and low-temperature fixing property, the difference between Tη and Tg is preferably 0° C. to 100° C., more preferably 10° C. to 90° C., particularly preferably 20° C. to 80° C.

The polyester contained in the binder resin (toner binder) of the toner of the present invention preferably has a molecular weight peak of 1,000 to 30,000, a component having a molecular weight of 30,000 or higher in an amount of 1% by mass to 80% by mass, and a number average molecular weight of 2,000 to 15,000, in the molecular weight distribution of THF soluble matter thereof. Also, the polyester preferably contains a component having a molecular weight of 1,000 or lower in an amount of 0.1% by mass to 5.0% by mass in the molecular weight distribution of THF soluble matter of the polyester contained in the toner binder. In addition, the polyester contained in the toner binder preferably contains THF insoluble matter in an amount of 1% by mass to 15% by mass.

In the present invention, the number average molecular weight and weight average molecular weight can be measured by the gel permeation chromatography (GPC) as follows.

A column is conditioned in a heat chamber at 40° C., and then tetrahydrofuran is caused to pass through the column at a flow rate of 1 mL/min. Subsequently, a separately prepared tetrahydrofuran solution of a sample (concentration: 0.05% by mass to 0.6% by mass) is applied to the column in an amount of 50 μL to 200 μL.

The molecular weight distribution of the sample is determined based on the relationship between the logarithmic value and the count number of a calibration curve given by using several standard samples.

The standard samples may be, for example, monodisperse polystyrenes each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (product of Pressure Chemical Co. or Tosoh Co.). Preferably, at least about 10 standard samples are used.

The detector to be used is a refractive index detector.

In the present invention, the toner particles having different specific shapes; e.g., amorphous toner particles having an average circularity lower than 0.95 which is far from a spherical shape, cannot exhibit satisfactory transferability nor form high-quality images with no dust.

Notably, an appropriate measurement method for circularity is a method employing an optical detection zone, in which a suspension liquid containing particles is caused to pass through an image detection zone on a flat plate, and an image of the particles is optically detected with a CCD camera and then analyzed.

Here, the average circularity is a value calculated by dividing the circumferential length of a circle having the same area as the projected area obtained in this manner by the circumferential length of an actual particle. The average circularity of the toner particles according to the present invention is preferably 0.95 to 0.99 for forming high-definition images having reproducibility at appropriate density. More preferably, the average circularity of the toner particles is 0.96 to 0.99, and the amount of particles having a circularity less than 0.96 is 10% or less.

When the average circularity is 0.991 or more, cleaning failures occur on the photoconductor and the transfer belt in an image forming system using blade cleaning technique, causing staining on the images. Such cleaning failures are not problematic for development and transfer of an image having a low image occupation rate, since the amount of the toner remaining after transfer is small. While, when forming an image having a high image occupation rate such as a photographic image, an untransferred toner due to, for example, a paper-feeding failure accumulates on the photoconductor as residual toner after transfer, causing background smear on images, or also contaminating, for example, a charging roller that contact-charges the photoconductor whereby the charging roller cannot exert their intrinsic chargeability.

The average circularity can be measured using a flow-type particle image analyzer FPIA-2000 (product of Sysmex Corp.).

Specific measurement method is as follows: 0.1 mL to 0.5 mL of a surfactant (preferably an alkylbenzene sulfonic acid salt) serving as a dispersing agent is added to a vessel containing 100 mL to 150 mL of water from which solid impurities have previously been removed; about 0.1 g to about 0.5 g of a measurement sample (toner particles) is added to the vessel; the resultant suspension liquid containing the sample dispersed therein is dispersed with an ultrasonic wave disperser for about 1 min to about 3 min to adjust the concentration of the dispersion liquid to 3,000 particles/μL to 10,000 particles/μL; and the thus-treated toner particles are measured for shape and distribution with the above analyzer.

The volume average particle diameter (D4) of the base particles in the present invention is preferably 3.0 μm or more but less than 6.0 μm. The ratio (D4/D1) of volume average particle diameter (D4) to number average particle diameter (D1) is preferably 1.05 to 1.25, more preferably 1.05 to 1.20.

In the present invention, the particle size distribution can be measured using the Coulter counter method.

Examples of an apparatus for measuring the particle size distribution include a COULTER COUNTER TA-II and COULTER MULTISIZER II (these products are of Coulter, Inc.).

Specifically, first, a surfactant (0.1 mL to 5 mL), preferably an alkylbenzene sulfonic acid salt, is added as a dispersing agent to an electrolyte solution (100 mL to 150 mL).

Here, the electrolyte solution is an about 1% by mass aqueous solution prepared using 1st grade sodium chloride, and examples of commercially available products thereof include ISOTON-II (product of Coulter, Inc.).

Subsequently, a sample of 2 mg to 20 mg is suspended in the above-obtained electrolyte solution. The resultant electrolyte solution is dispersed with an ultrasonic wave disperser for 1 minute to 3 minutes.

The thus-obtained dispersion liquid is analyzed with the above-described apparatus using an aperture of 100 μm to measure the number and volume of the toner. Then, the volume particle size distribution and number particle size distribution are calculated from the obtained values.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

Use of toner (dry toner) particles containing the above base particles prevents contamination against charging members (e.g., a carrier and a charging blade), decrease in charging capability over time, and toner scattering. In addition, the toner particles are excellent in all of heat resistance storage stability, low-temperature fixing property, and hot offset resistance. Especially when used in a full-color copier, the toner particles form an image having excellent glossiness. Furthermore, for a two-component developer, the toner particles less change in particle diameter in the developer even after toner particles have been consumed and supplied repeatedly for a long period of time. As a result, the two-component developer containing the toner particles can exhibit good, stable developability even when stirred in the developing device for a long period of time.

Also, a one-component developer containing the toner particles less changes in particle diameter even after the toner particles have been consumed and supplied repeatedly. The one-component developer does not cause filming of the toner on a developing roller or fusion of the toner on a member for thinning a toner layer (e.g., a blade). The one-component developer can attain good, stable developability and image formation even when used (stirred) for a long period of time.

In general, toner particles having a smaller particle diameter are more advantageous in forming an image having high resolution and high quality. Such toner particles are disadvantageous in transferability and cleanability. When the volume average particle diameter is smaller than the range of the present invention, a two-component developer containing a carrier and a toner having a small volume average particle diameter causes fusion of the toner on the carrier and decreases charging capability of the carrier as a result of a long-term stirring in a developing device. A one-component developer containing a toner having a small volume average particle diameter easily causes filming of the toner on a developing roller and fusion of the toner on a member for thinning a toner layer (e.g., a blade). These phenomena arise also in a toner containing a larger amount of fine powder (particles having much smaller particle diameter) than the range of the present invention.

When the particle diameter of the toner is larger than the range of the present invention, it is difficult to obtain an image having high resolution and high quality. When the toner contained in the developer is consumed and supplied repeatedly, the variation in particle diameter of the toner particles becomes large in many cases. The same phenomenon arises in the case where the ratio (D4/D1) of volume average particle diameter (D4) to number average particle diameter (D1) of the base particles is more than 1.25. When the ratio D4/D1 is less than 1.05, the toner cannot be satisfactorily charged and cleaned in some cases, although there is a favorable aspect that the toner is stabilized in behavior and is uniformly charged.

The toner having a particle diameter within the range of the present invention solves these problems.

In the toner of the present invention, a colorant can be used as a component of the toner material. The colorant may be any known dyes or pigments. Examples of the colorant include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone, and mixtures thereof. The amount of the colorant is generally 1% by mass to 15% by mass, preferably 3% by mass to 10% by mass, with respect to the toner.

The colorant for use in the present invention may be mixed with a resin to form a masterbatch.

Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required). In this mixing/kneading, a high-shearing disperser (e.g., three-roll mill) is preferably used.

(Charge Controlling Agent)

If necessary, the toner material to be used for the toner of the present invention may contain a charge controlling agent. The charge controlling agent may be any charge controlling agents. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, a functional group such as a sulfonic acid group, carboxyl group, or quaternary ammonium salt.

The amount of the charge controlling agent used in the present invention is not determined flatly and is varied depending on the type of the binder resin used, on an optionally used additive, and on the toner production method used (including the dispersion method used). The amount of the charge controlling agent to be used is preferably 0.1 parts by mass to 10 parts by mass, more preferably 0.2 parts by mass to 5 parts by mass, per 100 parts by mass of the binder resin. When the amount of the charge controlling agent is more than 10 parts by mass, the formed toner has too high chargeability, resulting in that the charge controlling agent exhibits reduced effects. As a result, the electrostatic force increases between the developing roller and the developer, decreasing the fluidity of the developer and forming an image with reduced color density. The charge controlling agent may be melt-kneaded together with a masterbatch or resin before dissolution or dispersion. Alternatively, it may be directly added at the time when toner components are dissolved or dispersed in an organic solvent at the preparation step of a toner material liquid (oil phase). Furthermore, after the formation of the base particles, it may be fixed on the surfaces of the base particles.

(Fine Resin Particles)

In the present invention, fine resin particles may be used for forming base particles. Use of fine resin particles can improve dispersion stability. In addition, the toner particles formed from base particles can be narrowed in particle size distribution.

The resin used for the fine resin particles in the present invention may be any resin, so long as they can form desired dispersion liquid when a toner material liquid (oil phase), which has been obtained by dissolving or dispersing in an organic solvent the toner material containing at least a binder resin and/or a binder resin precursor and a releasing agent, is emulsified or dispersed in an aqueous medium (aqueous phase).

The fine resin particles may be a thermoplastic resin or a thermosetting resin. Examples thereof include vinyl resins, polyurethans, epoxy resins, polyesters, polyamides, polyimides, silicon-containing resins, phenol resins, melamine resins, urea resins, aniline resins, ionomer resins and polycarbonates. Two or more of these resins may be used in combination. Among them, preferred are vinyl resins, polyurethans, epoxy resins, polyesters and mixtures thereof, from the viewpoint of easily obtaining aqueous dispersoids of fine spherical resin particles.

The vinyl resin is a polymer produced through homopolymerization or copolymerization of vinyl monomers. Examples of the vinyl resin include styrene-(meth)acylate resins, styrene-butadiene copolymers, (meth)acrylic acid-acrylate polymers, styrene-acrylonitrile copolymers, styrene-maleic anhydride copolymers and styrene-(meth)acrylic acid copolymers. The volume average particle diameter of the fine resin particles is preferably 5 nm to 500 nm.

(External Additive)

The toner of the present invention is formed of the base particles of particles (colored particles) that are granulated through desolvation of an emulsion or dispersion liquid of the toner material liquid (oil phase) in the aqueous medium (aqueous phase). Here, in order to improve flowability, developability, chargeability and cleanability of the toner containing the base particles, an external additive may be added and attached onto the surfaces of the base particles.

The external additive for promoting flowability, developability and chargeability is preferably fine inorganic particles. The primary particle diameter of the fine inorganic particles to be used is preferably 5 nm to 2 μm, particularly preferably 5 nm to 500 nm.

Also, the specific surface area of the toner containing the base particles as measured with the BET method is preferably 20 $m^2/g$ to 500 $m^2/g$. The amount of the fine inorganic particles used is preferably 0.01% by mass to 5% by mass, more preferably 0.01% by mass to 2.0% by mass.

Specific examples of the above fine inorganic particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

Besides those listed above, fine polymer particles may be used as the external additive. Examples thereof include polystyrenes, methacrylic acid esters, acrylate copolymers, polycondensates (e.g., silicone, benzoguanamine and nylon) and polymer particles of thermosetting resins, which are produced through soap-free emulsion polymerization, suspension polymerization and dispersion polymerization.

A fluidizing agent is an agent improving hydrophobic properties through surface treatment, and is capable of inhibiting the degradation of flowability or chargeability under high humidity environment. Preferred examples of the fluidizing agent include silane coupling agents, silylation agents, silane coupling agents having a fluorinated alkyl group, organotitanate coupling agents, aluminum coupling agents, silicone oils, and modified silicone oils.

The cleanability improving agent is applied to the photoconductor and the primary transfer medium for facilitating removal of the developer (toner) remaining thereon after transfer. Examples thereof include fatty acid (e.g. stearic acid) metal salts such as zinc stearate, and calcium stearate; and fine polymer particles produced through soap-free emulsification polymerization such as polymethyl methacrylate fine particles and polystyrene fine particles. The fine polymer particles preferably have a relatively narrow particle size distribution and a volume average particle diameter of 0.01 μm to 1 μm.

The method for producing the toner of the present invention will be described referring to examples, but is not limited thereto.

The toner of the present invention can be prepared through a process including: dissolving or dispersing, in the organic solvent, the toner material containing the above-mentioned binder resin material and optional other substances to thereby prepare a toner material liquid; emulsifying or dispersing the toner material liquid (oil phase) in the aqueous medium (aqueous phase); and performing desolvation for granulation.

In addition, the above-mentioned binder resin may be synthesized as follows. Specifically, a material forming the toner material containing the above-mentioned binder resin material and optional other substances are dissolved or dispersed in an organic solvent to prepare a toner material liquid and then the toner material liquid (oil phase) is emulsified or dispersed in an aqueous medium (aqueous phase). The above-mentioned binder resin is synthesized during and/or after the emulsification or dispersion.

By performing the synthesis of the binder resin during and/or after the emulsification or dispersion, the viscosity of the oil phase at forming particles is suppressed, allowing the emulsification or dispersion in the aqueous phase satisfactory and the particle diameter or particle distribution of the toner can be controlled to a desired one. Further, polymerization reaction can be performed even after emulsification or dispersion, thereby enabling inclusion of the resin obtained by reaction between an epoxy ring and an active hydrogen compound.

(Emulsification or Dispersion of Toner Material Liquid (Oil Phase) in Aqueous Medium (Aqueous Phase))

The aqueous medium (aqueous phase) for use in the present invention may be water alone or a mixture of water and a water-miscible solvent.

Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

The aqueous medium (aqueous phase) may contain a dispersing agent such as a surfactant and a polymeric protective colloid described below.

For forming base particles, the binder resin may be obtained by allowing binder resin materials such as the (A) epoxy resin prepolymer, (B) adduct of a dihydric phenol with a polyalkylene oxide, (C) phenolic compound and/or an alcohol compound, and (D) carboxylic acid compound to react with each other in an oil phase in an aqueous medium. Alternatively, binder resins may be used that have been prepared in advance by allowing binder resin materials such as the (A) epoxy resin prepolymer, (B) adduct of a dihydric phenol with a polyalkylene oxide, (C) phenolic compound and/or alcohol compound, and (D) carboxylic acid compound to react with each other.

The method for stably dispersing, in an aqueous medium, an oil phase containing the toner material includes a method through application of shearing force so as to disperse, in an aqueous medium, an oil phase that contains a binder resin and/or a binder resin material; and other substances such as a colorant and a releasing agent.

The binder resin and/or the binder resin material may be mixed with other substances such as a colorant (or a colorant masterbatch), a releasing agent and a charge controlling agent when forming dispersoids in an aqueous medium. Preferably, the binder resin and/or the binder resin material are previously mixed together, and then a mixture of other substances is added to the mixture of the binder resin and/or the binder resin material and the resulting mixture is dispersed in an aqueous medium.

Also, in the present invention, other substances such as a colorant and a charge controlling agent are not necessarily added to an aqueous medium before particle formation. These other substances may be added thereto after particle formation. For example, after particles containing no colorant have been formed, a colorant may be added to the obtained particles with a known dying method.

The dispersion method is not particularly limited and may use a known disperser such as a low-speed shearing disperser, a high-speed shearing disperser, a friction disperser, a high-pressure jetting disperser or an ultrasonic disperser. The method using a high-speed shearing disperser is preferably employed in order for the dispersoids to be dispersed so as to have a particle diameter of 2 μm to 20 μm. In use of the high-speed shearing disperser, the rotating speed is not particularly limited. It is generally 1,000 rpm to 30,000 rpm, preferably 5,000 rpm to 20,000 rpm. The dispersion time is not particularly limited. It is generally 0.1 min to 5 min when a batch method is employed. The temperature during dispersion is generally 0° C. to 150° C. (in a pressurized state), preferably from 40° C. to 98° C. The temperature is preferably higher, since the oil phase containing the toner material has a lower viscosity and thus can be readily dispersed.

The amount of the aqueous medium used is generally 50 parts by mass to 2,000 parts by mass, preferably 100 parts by mass to 1,000 parts by mass, per 100 parts by mass of the toner material. When the amount of the aqueous medium used is less than 50 parts by mass, the toner composition cannot be sufficiently dispersed, resulting in failure to form toner particles having a predetermined particle diameter. Meanwhile, use of the aqueous medium in an amount of more than 2,000 parts by mass is economically disadvantageous.

As described above, if necessary, a dispersing agent may be used. Use of the dispersant is preferred from the viewpoints of attaining a sharp particle size distribution and realizing a stable dispersion state.

As described above, the step in which the (A) epoxy resin prepolymer; (B) adduct of a dihydric phenol with a polyalkylene oxide; (C) a phenolic compound, or an alcohol compound, or both thereof; and (D) carboxylic acid compound is allowed to react with each other may be performed in advance before dispersing, in the aqueous medium, the toner material liquid containing the (A) (oil phase), or may be performed during and/or after emulsifying, in the aqueous medium, the toner material liquid containing the (A) (oil phase).

A surfactant may be used as a dispersing agent for emulsifying or dispersing, in a water-containing liquid (aqueous medium: aqueous phase), a toner material liquid (oily phase: oil phase) containing the toner material dispersed therein.

Examples of the surfactant include: anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline) and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl) glycine and N-alkyl-N,N-dimethylammonium betaine.

Also, use of a fluoroalkyl group-containing surfactant can provide advantageous effects even in a considerably small amount. Preferable examples of the fluoroalkyl group-containing anionic surfactant include fluoroalkyl carboxylic acids having 2 to 10 carbon atoms and metal salts thereof, disodium perfluorooctanesulfonylglutamate, sodium 3-[omega-fluoroalkyl(C6 to C11)oxy)-1-alkyl(C3 or C4) sulfonates, sodium 3-[omega-fluoroalkanoyl(C6 to C8)-N-ethylamino]-1-propanesulfonates, fluoroalkyl(C11 to C20) carboxylic acids and metal salts thereof, perfluoroalkylcarboxylic acids (C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10) sulfoneamidepropyltrimethylammonium salts, salts of perfluoroalkyl(C6 to C10)-N-ethylsulfonylglycin and monoperfluoroalkyl(C6 to C16) ethylphosphates.

Examples of commercially available products thereof include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of DIC, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

Examples of the cationic surfactants include fluoroalkyl group-containing primary, secondary or tertiary aliphatic amine acids, aliphatic quaternary ammonium salts (e.g., perfluoroalkyl(C6 to C10)sulfoneamide propyltrimethylammonium salts), benzalkonium salts, benzetonium chloride, pyridinium salts and imidazolinium salts. Examples of commercially available products thereof include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of DIC, Inc.); EFTOP EF-132 (product of Tohchem Products Co., Ltd.); and FUTARGENT F-300 (product of Neos COMPANY LIMITED).

In addition, poorly water-soluble inorganic dispersing agents may be used. Examples of the poorly water-soluble inorganic dispersing agents usable include tricalcium phosphate, calcium carbonate, titanium oxide, colloidal silica and hydroxyapatite.

Further, a polymeric protective colloid may be used to stabilize liquid droplets. Examples of the polymeric protective colloid include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide); vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetoneacrylamide and methylol compounds thereof, acid chlorides (e.g., acrylic acid chloride and methacrylic acid chloride); and homopolymers or copolymers of, for example, nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylenes, polyoxypropylenes, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles. Also, the calcium phosphate may be removed through enzymatic decomposition.

Alternatively, the dispersing agent used may remain on the surfaces of the toner particles. However, the dispersing agent is preferably removed after elongation and/or crosslinking reaction through washing in view of chargeability of the formed toner.

In order to decrease the viscosity of the toner material liquid (oil phase) containing the toner material dissolved or dispersed therein, a solvent capable of dissolving the binder resin and the binder resin material may be additionally used. Use of such a solvent is preferred since a sharp particle size distribution can be attained. The solvent used is preferably a volatile solvent having a boiling point lower than 100° C. from the viewpoint of easily removing the solvent.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. In particular, the solvent is preferably an aromatic solvent such as toluene or xylene; or a halogenated hydrocarbon such as methylene chloride, 1,2-dichloroethane, chloroform or carbon tetrachloride.

The amount of the solvent used is generally 0 parts by mass to 300 parts by mass, preferably 0 parts by mass to 100 parts by mass, more preferably 25 parts by mass to 70 parts by mass, per 100 parts of the binder resin and/or binder resin material.

(Removal of Solvent)

In order to remove the organic solvent from the emulsion or dispersion liquid obtained by emulsifying or dispersing the toner material liquid (oil phase) in an aqueous medium (aqueous phase), there can be employed a method in which the entire system is gradually increased in temperature to completely evaporate off the organic solvent contained in the liquid droplets. Alternatively, there can be employed a method in which the emulsion or dispersion liquid is sprayed to a dry atmosphere, to thereby completely evaporate off the water-insoluble organic solvent contained in the liquid droplets to form fine particles of base particles as well as evaporate off the aqueous dispersing agent.

The dry atmosphere to which the emulsified dispersion liquid is sprayed generally uses heated gas (e.g., air, nitrogen, carbon dioxide and combustion gas), especially, gas flow heated to a temperature equal to or higher than the highest boiling point of the solvents used. Treatments performed even in a short time using, for example, a spray dryer, a belt dryer or a rotary kiln allow the resultant product to have satisfactory quality.

(Washing and Drying)

When the emulsified or dispersed particles having a broad particle size distribution are subjected to washing and drying treatments as is, the washed and dried particles may be classified so as to have a desired particle size distribution.

(Classification)

Classification is performed by removing fine particles of unnecessary size using, for example, a cyclone, a decanter, or a centrifugal separator in the liquid. Needless to say, classification may be performed on powder obtained after drying but is preferably performed in the liquid from the viewpoint of high efficiency. The classified fine or coarse particles of unnecessary size may be returned to the kneading step, where they may be used again for formation of particles. Here, the fine or coarse particles may be in a wet or dry state.

The dispersing agent used is preferably removed from the obtained dispersion liquid to the greatest extent possible. Preferably, the dispersing agent is removed through the above-described classification.

The obtained powder after drying (base particles) is optionally mixed with foreign particles such as fine particles of the releasing agent, charge-controlling fine particles, fine particles of the fluidizing agent and colorant fine particles, optionally the resultant mixture is allowed to receive mechanical impact, so that the foreign particles are fixed or fused on the base particles, to thereby obtain toner particles formed of the base particles (toner particles containing the base particles). The application of mechanical impact can prevent the foreign particles from being exfoliated from the surfaces of the obtained toner particles containing base particles (composite particles).

Examples of the method for applying mechanical impact include a method in which an impact is applied to a mixture using a high-speed rotating blade and a method in which a mixture is caused to pass through a high-speed airflow for acceleration and aggregated particles or complex particles are crushed against an appropriate collision plate.

Examples of apparatuses used for applying mechanical impact include ONGMILL (product of Hosokawa Micron Corp.), an apparatus produced by modifying an I-type mill (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

As described above, the toner of the present invention may be used as a one-component developer or a two-component developer. When used for the two-component developer, the toner containing the base particles according to the present invention may be mixed with a magnetic carrier. The ratio of the amount of the carrier to the amount of the toner in the developer is preferably 1 part by mass to 10 parts by mass of the toner per 100 parts by mass of the carrier.

Conventionally known carriers (e.g. iron powder, ferrite powder, magnetite powder and magnetic resin carriers) with a particle size of approximately 20 μm to 200 μm can be used as the magnetic carrier.

Examples of the coating material of the magnetic carrier include amino-based resins such as urea-formaldehyde resins, melamine resins, benzoguanamine resins, urea resins, polyamide resins and epoxy resins. In addition, for example, polyvinyl- or polyvinylidene-based resins such as acryl resins, polymethyl methacrylate resins, polyacrylonitrile resins, polyvinyl acetate resins, polyvinyl alcohol resins and polyvinyl butyral resins; polystyrene-based resins such as polystyrene resins and styrene-acryl copolymer resins; halogenated olefin resins such as polyvinyl chloride; polyester-based resins such as polyethylene terephthalate resins and polybutyrene terephthalate resins; polycarbonate-based resins, polyethylene resins, polyvinyl fluoride resins, polyvinylidene fluoride resins, polytrifluoroethylene resins, polyhexafluoropropylene resins, copolymers of vinylidene fluoride and an acryl monomer, copolymers of vinylidene fluoride and vinyl fluoride, fluoroterpolymers such as terpolymers of tetrafluoroethylene, vinylidene fluoride and a non-fluorinated monomer; and silicone resins can be used.

If necessary, for example, conductive powder may be incorporated into the coating resin. The conductive powder may be, for example, metal powder, carbon black, titanium oxide, tin oxide and zinc oxide. These conductive powders preferably have an average particle diameter of 1 μm or lower. When the average particle diameter exceeds 1 μm, it is difficult to control electrical resistance.

Also, the toner of the present invention may be used as a one-component developer using no carrier.

As described above, an image forming method associated with the present invention includes: charging a surface of an image bearing member; developing a latent electrostatic image formed on the charged image bearing member with a developer containing the toner of the present invention or a developer containing the toner of the present invention and a carrier; transferring a toner image formed on the image bearing member onto an image support; and fixing the transferred image on the image support by applying heat and/or pressure by means of a roller- or belt-shaped fixing member to obtain a fixed image.

The image forming method is performed by, for example, an electrophotographic image forming apparatus schematically illustrated in FIG. 1. Next will be described the schematic configuration of the image forming apparatus illustrated in FIG. 1.

While a photoconductor (image bearing member) (1) is being rotated in a direction indicated by the arrow, the surface thereof is uniformly charged with a charger (2) (charging step). Next, the photoconductor (1) is irradiated with image light r from an exposing unit (not shown) at an exposing region located downstream of the charger (2) in the rotation direction of the photoconductor.

Through this light irradiation, charges disappear at regions of the photoconductor surface which have been irradiated with the image light r. As a result, a latent electrostatic image corresponding to the image light is formed on the surface of the photoconductor (1).

A developing device (3) serving as a developing unit is disposed downstream of the exposing region. The developing device (3) houses a toner (4) as a developer. The toner (4) is stirred/mixed with a paddle (stirring mechanism) (14) equipped with a conveying screw (13) to be frictionally charged so as to have a predetermined polarity. Then, the toner is conveyed with a developing sleeve (5) to a nip portion (developing region) between the developing sleeve (5) and the photoconductor (1). The toner conveyed to the developing region is transferred from the surface of the developing sleeve (5) to the surface of the photoconductor (1) by the action of a developing electrical field formed at the developing region with a developing bias applying unit (not shown), whereby the toner is attached onto the photoconductor. As a result, the latent electrostatic image formed on the photoconductor surface is developed to be a toner image (visible image) (developing step).

The toner image formed on the photoconductor (1) in this manner is transferred onto a transfer paper sheet S serving as an image-receiving medium. Prior to the image transfer, the transfer paper sheet is fed with a registration roller (18) to a transfer region, which is a nip portion between the photoconductor (1) and a transfer conveyance belt (6) (serving as a transfer unit) disposed downstream of the developing device (3) so as to be in close contact with the photoconductor (1) (transfer step). Then, the toner image transferred onto the transfer paper sheet is fixed with a fixing roller (not shown), serving as a fixing unit, disposed downstream of the transfer conveyance belt (6) in the rotation direction thereof (fixed image obtaining step). Thereafter, the transfer paper sheet is discharged with a discharging unit (not shown) onto a discharge tray outside the main body of the apparatus. The transfer conveyance belt (6) is spanned around the bias roller (6*a*).

The toner remaining on the photoconductor (1) (residual toner), which has not been transferred onto the transfer paper sheet at the transfer region, is removed from the photoconductor (1) with a cleaning device (serving as a cleaning unit) including a cleaning blade (7), a recovering spring (8) and a recovering coil (9), which is disposed downstream of the transfer region in the rotation direction of the photoconductor. Also, the residual charges remaining on the photoconductor (1) after cleaning of the residual toner are eliminated with a charge-eliminating device (20) including a charge-eliminating lamp. In FIG. 1, reference numeral (16) denotes a reflection density detection sensor (P sensor), reference numeral (17) denotes a toner concentration sensor, and reference numeral (10) denotes a photoconductor and cleaning unit (PCU).

EXAMPLES

The present invention will be specifically explained through examples hereinafter, but these examples shall not be construed as to limit the scope of the present invention.

Note that the unit "part(s)" means "part(s) by mass."

Example 1

<Preparation of Fine Resin Particle Dispersion Liquid>

A reaction container to which a stirring rod and a thermometer had been set was charged with 683 parts of water, 11 parts of a sodium salt of sulfate of an ethylene oxide adduct of methacrylic acid (Eleminol RS-30, product of Sanyo Chemical Industries, Ltd.), 83 parts of styrene, 83 parts of methacrylic acid, 110 parts of butyl acrylate and 1 part of ammonium persulfate. The resultant mixture was stirred at 400 rpm for 15 min and a white emulsion was obtained.

The system of the obtained white emulsion was increased in temperature to 75° C., followed by reaction for 5 hours.

Then, 30 parts of a 1% by mass aqueous ammonium persulfate solution was added to the resultant emulsion, and the resultant mixture was aged at 75° C. for 5 hours to thereby obtain [fine resin particle dispersion liquid 1], an aqueous dispersion liquid of a vinyl resin (copolymer of styrene-methacrylic acid-butyl acrylate-sodium salt of sulfate of an ethylene oxide adduct of methacrylic acid).

Through measurement with LA-920 (laser beam scattering apparatus, product of HORIBA, Ltd.), the [fine resin particle dispersion liquid 1] was found to have a volume average particle diameter of 105 nm.

Part of the [fine resin particle dispersion liquid 1] was dried to isolate resin. This resin was found to have a glass transition temperature of 59° C. and a weight average molecular weight of 1,500,000.

<Preparation of Resin Formed of Epoxy Resin Prepolymer>

A 500 mL-volume separable flask equipped with a stirring device, a thermometer, a nitrogen-inlet tube, and a condenser was charged with 156.1 g of low molecular weight bisphenol A liquid epoxy resin (Epomic R140P, product of Mitsui Chemicals, epoxy equivalent: 188 (g/equiv.), viscosity: 13,500 mPa·s), 15.0 parts of high molecular weight bisphenol A liquid epoxy resin (Epomic R309R, product of Mitsui Chemicals, epoxy equivalent: 2630 (g/equiv.)), 60.3 g of bisphenol A, 23.6 g of benzoic acid, 45.0 parts of adduct of bisphenol A propylene oxide adduct (KB-280, product of Mitsui Chemicals) with phthalic anhydride, and 33.3 parts of xylene. The resultant mixture was started to be increased in temperature in a nitrogen atmosphere and then at the internal temperature of 80° C., 0.12 parts of 50% by mass aqueous solution of tetramethylammonium chloride as a reaction catalyst was added thereto.

The mixture was increased in temperature and when the internal temperature reached at 160° C., the reaction started in the solution.

While maintaining the temperature, the reaction was carried out for 1 hour and 0.12 parts of 50% by mass aqueous solution of tetramethylammonium chloride as a catalyst was added again to the reaction mixture. Then, concentration of xylene was started under reduced pressure, and while maintaining the temperature, the pressure was reduced to 10 mmHg over approximately one hour.

While maintaining the temperature of the reaction mixture at 160° C., the reaction mixture was stirred and the reaction was allowed to proceed.

During the reaction, the residual amount of an epoxy group was measured every predetermined period. After about 6 hours, epoxy equivalent was found to be 20,000 (g/equivalent) or more, indicating that an epoxy group substantially disappeared.

The produced resin in a molten state was removed from the flask to obtain [epoxy reacted resin 1].

The obtained [epoxy reacted resin 1] was found to have a glass transition temperature of 65° C., an acid value of 8.5 (mgKOH/g), and a weight average molecular weight, Mw, of 16,000.

The epoxy equivalent was determined as described below.

The resin sample (0.2 g to 5 g) is accurately weighed and placed in a 200 mL Erlenmeyer flask, followed by the addition of 25 mL of dioxane to make a solution.

Twenty five milliliters of 0.2N hydrochloric acid solution (solvent: dioxane) is added to the Erlenmeyer flask. The flask is sealed. After thoroughly mixing the content in the sealed flask, the flask is allowed to stand for 30 minutes.

Then, 50 mL of toluene-ethanol mixed solution (1:1 volume ratio) is added to the solution, followed by titration with a 0.1N sodium hydroxide solution using cresol red as an indicator.

Based on the result of titration, the epoxy equivalent (g/equiv.) is calculated according to the following equation:

$$\text{Epoxy equivalent (g/equiv.)}=1000\times W/[(B-S)\times N\times F]$$

W: weight (g) of the resin sample

B: volume (mL) of the sodium hydroxide solution added in the blank test

S: volume (mL) of 0.1N sodium hydroxide solution added in the test of the sample N: normality of the sodium hydroxide solution F: factor (titer) of the sodium hydroxide solution.

<Preparation of Polyester Resin>

Into a reaction container to which a condenser, a stirrer and a nitrogen-introducing pipe had been set, 229 parts of ethylene oxide 2 mol adduct of bisphenol A, 529 parts of propylene oxide 3 mol adduct of bisphenol A, 208 parts of terephthalic acid, 46 parts of isophthalic acid, and 2 parts of dibutyltin oxide are placed, and subjected to a reaction for 5 hours at 230° C. under normal pressure in a nitrogen atmosphere. Subsequently, the mixture is subjected to a reaction for 5 hours at a reduced pressure of 1.3 kPa to 2.0 kPa.

Then, 44 parts of trimellitic anhydride were added thereto, and the mixture was subjected to a reaction for 2 hours at 180° C. under normal pressure. Thus, [polyester resin 1] was obtained. The obtained [polyester resin 1] had a weight average molecular weight of 5,200 for tetrahydrofuran-soluble content, a glass transition temperature of 45° C., and an acid value of 20 mgKOH/g.

<Production of Toner Particles>

Into a beaker, 90 parts of [epoxy reacted resin 1], 90 parts of [polyester resin 1], and 80 parts of ethyl acetate were poured and mixed to prepare a solution.

Separately, 10 parts of carnauba wax, 12 parts of carbon black, and 120 parts of ethyl acetate were introduced into a bead mill to disperse them for 60 minutes. The above solution and the dispersion liquid were mixed and stirred at 8,000 rpm for 30 minutes by use of TK homomixer, followed by dispersing 10 minutes by use of the bead mill to thereby prepare [oil phase 1].

Into a beaker, 526.5 parts of deionized water, 70 parts of fine resin particle dispersion liquid 1, and 0.5 part of sodium dodecylbenzene sulfonate were introduced. While stirring at 10,000 rpm by use of TK homomixer, 403 parts of [oil phase 1] was added, followed by stirring for 30 minutes to obtain a dispersion slurry.

Next, ethyl acetate had been removed from the dispersion slurry until the mass ratio of ethyl acetate to the solid content reached 10%.

Further, the dispersion slurry was aged at 50° C. for 2 hours, followed by removal of ethyl acetate from the dispersion slurry.

Subsequently, filtering, rinsing, drying, and air-classifying were carried out to prepare base particles.

Next, 100 parts of the base particles and 0.25 part of a charge controlling agent Bontron E-84 (product of Orient Chemical Industries, Ltd.) were introduced into a Q-type mixer (product of Mitsui Mining Co.) and mixed.

In this mixing step, the circumferential velocity of turbine blades was set to 50 m/sec. The operation was 2 minutes of running and 1 minute of pausing per cycle, and this cycle was performed 5 times.

Thereafter, 0.5 parts of hydrophobic silica H2000 (product of Clariant (Japan) K.K.) was further added and mixed to obtain [toner 1].

In this mixing step, the operation was 30 seconds of running at circumferential velocity 15 m/sec and 1 minute of pausing per cycle, and this cycle was performed 5 times.

Comparative Example 1

Comparative toner 1 was prepared in the same manner as in Example 1, except that in the preparation of oil phase, [epoxy reacted resin 1] was not used, but 180 parts of [polyester resin 1] was used.

Example 2

<Preparation of Resin Formed of Epoxy Resin Prepolymer and Polyester Resin>

A 500 mL-volume separable flask equipped with a stirring device, a thermometer, a nitrogen-inlet, and a condenser was charged with 150 parts of low molecular weight bisphenol A liquid epoxy resin (Epomic R140P, product of Mitsui Chemicals, epoxy equivalent: 188 (g/equiv.), viscosity: 13,500 mPa·s), 150 parts of synthesized [polyester resin 1], and 100 parts of xylene. The resultant mixture was started to be increased in temperature in a nitrogen atmosphere and then at the internal temperature of 80° C., 0.12 parts of 50% by mass aqueous solution of tetramethylammonium chloride as a reaction catalyst was added thereto.

The mixture was increased in temperature and when the internal temperature reached at 160° C., the reaction started in the solution.

While maintaining the temperature, the reaction was carried out for 1 hour and 0.12 parts of 50% by mass aqueous solution of tetramethylammonium chloride as a catalyst was added again to the reaction mixture. Then, concentration of xylene was started under reduced pressure, and while maintaining the temperature, the pressure was reduced to 10 mmHg over approximately one hour.

While maintaining the temperature of the reaction mixture at 160° C., the reaction mixture was stirred and the reaction was allowed to proceed.

After 7 hours from the reaction initiation, 10 parts of an anhydride, hexahydrophthalic anhydride [RIKACID MH-700, product of New Japan Chemical Co., Ltd], was added to the flask and the acid value was measured every one hour. After about 4 hours, the acid value was stabilized at 15.0 (mgKOH/g) and remaining epoxy groups disappeared. The produced resin in a molten state was removed from the flask The obtained [epoxy-polyester reacted resin 1] was found to have a glass transition temperature of 52° C., an acid value of 15.0 (mgKOH/g), and a weight average molecular weight, Mw, of 18,000.

Into a beaker, 180 parts of [epoxy-polyester reacted resin 1] and 80 parts of ethyl acetate were poured and dissolved by stirring to prepare a solution. Separately, 10 parts of carnauba wax, 12 parts of carbon black, and 120 parts of ethyl acetate were introduced into a bead mill and dispersed for 60 minutes to prepare a dispersion liquid. The above solution and the dispersion liquid were mixed and stirred at 8,000 rpm for 30 minutes by use of TK homomixer, followed by dispersing for 10 minutes by use of the bead mill to thereby prepare [oil phase 2].

Subsequent emulsification and dispersion in the aqueous phase, and formation into toner was carried out in the same manner as in Example 1 to obtain [toner 2].

Example 3

In order to make the particle diameter of the toner of Example 2 smaller, emulsification and dispersion was carried out using [oil phase 2] used in Example 2 as an oil phase according to the following procedure to thereby prepare [toner 3].

Into a beaker, 526.5 parts of deionized water, 70 parts of [fine resin particle dispersion liquid 1], and 1.0 part of sodium dodecylbenzene sulfonate were introduced. While stirring at 15,000 rpm by use of TK homomixer, 403 parts of [oil phase 2] was added, followed by stirring for 30 minutes to obtain a dispersion slurry.

Subsequently, removal of ethyl acetate, filtering, rinsing, drying, air-classifying, and formation into toner were carried out in the same manner as in Example 1 to obtain [toner 3].

Example 4

Into a beaker, 40 parts of low molecular weight bisphenol A liquid epoxy resin (Epomic R140P, product of Mitsui Chemicals), 146 parts of [polyester resin 1] and 80 parts of ethyl acetate were poured and dissolved by stirring to prepare a solution.

Separately, 10 parts of carnauba wax, 12 parts of carbon black, and 120 parts of ethyl acetate were introduced into a bead mill and dispersed for 60 minutes to prepare a dispersion liquid.

The above solution and the dispersion liquid were mixed and stirred at 8,000 rpm for 5 minutes by use of TK homomixer, followed by dispersing for 30 minutes by use of the bead mill.

Next, 2 parts of adipic acid, 2 parts of diethylene glycol and 0.12 parts of 50% by mass aqueous solution of tetramethylammonium chloride were added and stirred at 8,000 rpm for 5 minutes by use of TK homomixer to thereby prepare [oil phase 4].

Into a beaker, 526.5 parts of deionized water, 70 parts of [fine resin particle dispersion liquid 1], and 0.5 parts of sodium dodecylbenzene sulfonate were introduced. While stirring at 10,000 rpm by use of TK homomixer, 403 parts of [oil phase 4] was added, followed by stirring for 30 minutes to obtain a dispersion slurry.

Next, ethyl acetate had been removed from the dispersion slurry until the mass ratio of ethyl acetate to the solid content reached 10%.

Further, the dispersion slurry was aged at 50° C. for 2 hours, followed by removal of ethyl acetate from the dispersion slurry.

Subsequently, filtering, rinsing, drying, and air-classifying were carried out to prepare base particles.

Formation into toner was carried out in the same manner as in Example 1 to obtain [toner 4].

Comparative Example 2

<Preparation of Polyester Prepolymer>

A reaction container equipped with a condenser, a stirrer and a nitrogen-introducing pipe was charged with 650 parts of ethylene oxide 2 mol adduct of bisphenol A, 95 parts of propylene oxide 2 mol adduct of bisphenol A, 295 parts of terephthalic acid, 28 parts of trimellitic anhydride, and 2 parts of dibutyl tinoxide, followed by reaction at 230° C. for 11 hours under normal pressure.

Next, the reaction mixture was allowed to react for 8 hours under a reduced pressure of 10 mmHg to 15 mmHg to synthesize [intermediate polyester resin].

The thus-obtained [intermediate polyester resin] was found to have a number average molecular weight of 2,100, a weight average molecular weight of 13,000, a glass transition temperature of 58° C., an acid value of 4 mgKOH/g and a hydroxyl value of 51 mgKOH/g.

Next, a reaction container equipped with a condenser, a stirrer and a nitrogen-introducing pipe was charged with 410 parts of [intermediate polyester resin], 89 parts of isophorone diisocyanate, and 500 parts of ethyl acetate, followed by reaction at 100° C. for 5 hours to synthesize [prepolymer 1].

The [prepolymer 1] thus obtained had a free isocyanate content of 1.53% by mass.

Into a beaker, 32 parts of [prepolymer 1], 146 parts of [polyester resin 1], and 80 parts of ethyl acetate were poured and mixed to prepare a solution.

Separately, 10 parts of carnauba wax, 12 parts of carbon black, and 120 parts of ethyl acetate were introduced into a bead mill to disperse them for 60 minutes.

The above solution and the dispersion liquid were mixed and stirred at 8,000 rpm for 5 minutes by use of TK homomixer, followed by dispersing for 30 minutes by use of the bead mill.

Next, 3 parts of isophoronediamine was added and stirred at 8,000 rpm for 5 minutes by use of TK homomixer to thereby prepare [comparative oil phase 2].

Into a beaker, 526.5 parts of deionized water, 70 parts of [fine resin particle dispersion liquid 1], and 0.5 part of sodium dodecylbenzene sulfonate were introduced. While stirring at 10,000 rpm by use of TK homomixer, 403 parts of [comparative oil phase 2] was added, followed by stirring for 30 minutes to obtain a dispersion slurry.

Next, ethyl acetate had been removed from the dispersion slurry until the mass ratio of ethyl acetate to the solid content reached 10%.

Further, the dispersion slurry was aged at 50° C. for 2 hours, followed by removal of ethyl acetate from the dispersion slurry.

Subsequently, filtering, rinsing, drying, and air-classifying were carried out to prepare base particles.

(Initial Charge Quantity)

In a test room at the temperature of 20° C. and the relative humidity of 50%, a stainless pot was charged with 100 parts of the carrier and 7 parts of the toner according to the present invention. The resulting materials were rotated and mixed at a constant number of revolutions on a mount of a ball mill. After the rotation was stopped at 60 seconds from the start of the rotation, the charge quantities (μC/g) of the resulting developers were measured using a blow off apparatus.

(Charge Quantity after Degradation)

The charge quantities (μC/g) of the developers after mixing for 60 minutes were measured using the blow off apparatus in the same manner as that used to evaluate charge rising property.

(Fixing Temperature Range)

The fixing properties were evaluated as follows. A solid image colored all over the surface thereof was outputted by means of MFP IMAGIO MPC 5001 manufactured by Ricoh Company Limited, with the variation of the surface temperature of a fixing roller ranging from 100° C. through 220° C. The toner on the image was transferred to a tape and the degree of the adhesion of the toner on the tape was evaluated on the basis of the following 4 ranks by comparing it with the references for each rank. The fixing temperature at which the degree of the adhesion of the toner on the tape was equal to or less than the standard was designated as the minimum fixing temperature, the fixing temperature at which the glossiness of the image started to decrease due to hot offset was designated as the upper limit of the fixing temperature, and the difference between the upper limit and the lower limit was designated as the fixing temperature range.

The evaluation results of the toners produced are shown in the Table 1 below.

TABLE 1

| | D4 (μm) | D4/D1 | Minimum fixing temperature (° C.) | Maximum fixing temperature (° C.) | Fixing temperature range (° C.) | Initial charge quantity (μC/g) | Charge quantity after degradation (μC/g) |
|---|---|---|---|---|---|---|---|
| Ex. 1 | 6.2 | 1.15 | 120 | 150 | 30 | 45 | 40 |
| Ex. 2 | 7.8 | 1.25 | 115 | 165 | 50 | 52 | 48 |
| Ex. 3 | 6.1 | 1.3 | 110 | 175 | 65 | 48 | 49 |
| Ex. 4 | 5.8 | 1.13 | 110 | 180 | 70 | 58 | 58 |
| Com. Ex. 1 | 6.4 | 1.16 | 140 | 160 | 20 | 18 | 5 |
| Com. Ex. 2 | 5.7 | 1.14 | 130 | 170 | 40 | 23 | 10 |

Formation into toner was carried out in the same manner as in Example 1 to obtain [comparative toner 2].

<Production of Carrier>

Core material: Spherical ferrite particles having an average particle diameter of 50 μm.

Materials forming coating material: Silicone resin in which an aminosilane-based coupling agent was dispersed.

The aminosilane-based coupling agent and the silicone resin were dispersed into toluene. After the dispersion liquid was prepared, the dispersion liquid in a heated state was spray-coated on the above core material, baked, and cooled to thereby prepare carrier particles having an average coat resin film thickness of 0.2 μm.

(Evaluation of Toners Obtained)

Five parts of the prepared color toner and 95 parts of the above carrier were mixed with a blender for 10 minutes to prepare a developer.

Toners 1 to 4 and comparative toners 1 and 2 were evaluated by the following methods.

What is claimed is:

1. A method for producing an electrophotographic toner, comprising:

emulsifying or dispersing, in an aqueous medium, an oil phase containing a toner material, where the toner material contains:

(A) an epoxy resin prepolymer;

(B) an adduct of a dihydric phenol with a polyalkylene oxide;

(C) a phenolic compound, or an alcohol compound, or both thereof; and (D) a carboxylic acid compound; and allowing the (A), the (B), the (C), and the (D) to react with each other during, or after, or during and after the emulsification or dispersion to obtain a resin, wherein the electrophotographic toner is obtained from a dispersion or emulsion liquid of the oil phase in the aqueous medium, wherein the toner contains a binder resin, and wherein the binder resin contains the resin obtained by allowing the (A), the (B), the (C) and the (D) to react with each other.

* * * * *